US006212332B1

(12) United States Patent
Sham et al.

(10) Patent No.: US 6,212,332 B1
(45) Date of Patent: Apr. 3, 2001

(54) STEAM IRON STATION

(76) Inventors: John C. K. Sham, Room 1508, Block C, 19 Broadwood Road, Hong Kong (HK); Kumkit Kunavong Vorakul, 8251/182 M001 Thungkru, Ratburna, Bangkok (TH)

( * ) Notice: Subject to any disclaimer, the term of this patent is extended or adjusted under 35 U.S.C. 154(b) by 0 days.

(21) Appl. No.: 09/211,898

(22) Filed: Dec. 15, 1998

(51) Int. Cl.[7] ..... A61H 33/12; D06F 75/06
(52) U.S. Cl. ..... 392/404; 38/77.6
(58) Field of Search ..... 38/74, 77.3, 77.4, 38/77.5, 77.6, 77.7, 77.8, 93; 219/245, 247, 248; 392/386, 394, 400, 401, 404, 405, 406

(56) References Cited

U.S. PATENT DOCUMENTS

| | | | | |
|---|---|---|---|---|
| D. 374,322 | | 10/1996 | Maeda et al. | D32/70 |
| D. 380,068 | | 6/1997 | Gudefin | D32/9 |
| 3,130,507 | | 4/1964 | Hoecker | 38/77 |
| 3,599,357 | | 8/1971 | Gronwick et al. | 38/77.5 |
| 4,197,664 | | 4/1980 | Hammer et al. | 38/77.83 |
| 4,535,556 | | 8/1985 | Cavilli | 38/77.6 |
| 4,565,019 | * | 1/1986 | Cavalli | 38/77.6 |
| 4,658,520 | * | 4/1987 | Henneberger et al. | 38/93 |
| 4,870,763 | | 10/1989 | Campbell | 38/77.7 |
| 4,920,668 | | 5/1990 | Henneberger et al. | 38/77.81 |
| 4,936,349 | * | 6/1990 | Cowgur | 137/899 |
| 5,138,778 | * | 8/1992 | Brandolini | 38/77.8 |
| 5,170,577 | | 12/1992 | Brandolini et al. | 38/77.8 |
| 5,315,773 | | 5/1994 | Iwami et al. | 38/77.6 |
| 5,390,432 | * | 2/1995 | Boulud et al. | 38/77.83 |
| 5,414,945 | | 5/1995 | Freeman et al. | 38/96 |
| 5,428,910 | | 7/1995 | Gudefin et al. | 38/77.6 |
| 5,638,622 | * | 6/1997 | Hohn | 38/77.5 |
| 5,832,639 | * | 11/1998 | Muncan | 38/77.6 |
| 5,842,295 | * | 12/1998 | Ching et al. | 38/77.6 |
| 5,983,536 | * | 11/1999 | Fourny et al. | 38/93 |

* cited by examiner

*Primary Examiner*—Sang Paik
(74) *Attorney, Agent, or Firm*—Peter S. Canelias

(57) ABSTRACT

A steam iron station has a removable tank mounted in a case. Also included is a conduit adapted to be coupled to a steam iron. Also included is a removable filter having an intake. The filter is mounted in the case to communicate with the tank. Also included is a pump mounted in the case and coupled to the filter and the conduit for discharging to the conduit, liquid drawn through the filter from the tank. The steam iron includes an electrical heater mounted in a soleplate. The soleplate has an upper channel and a lower channel. The iron has a duct for delivering liquid to the upper channel. The upper and the lower channels each have a forward flowing and a backward flowing branch. The upper channel serially communicates with the lower channel.

47 Claims, 11 Drawing Sheets

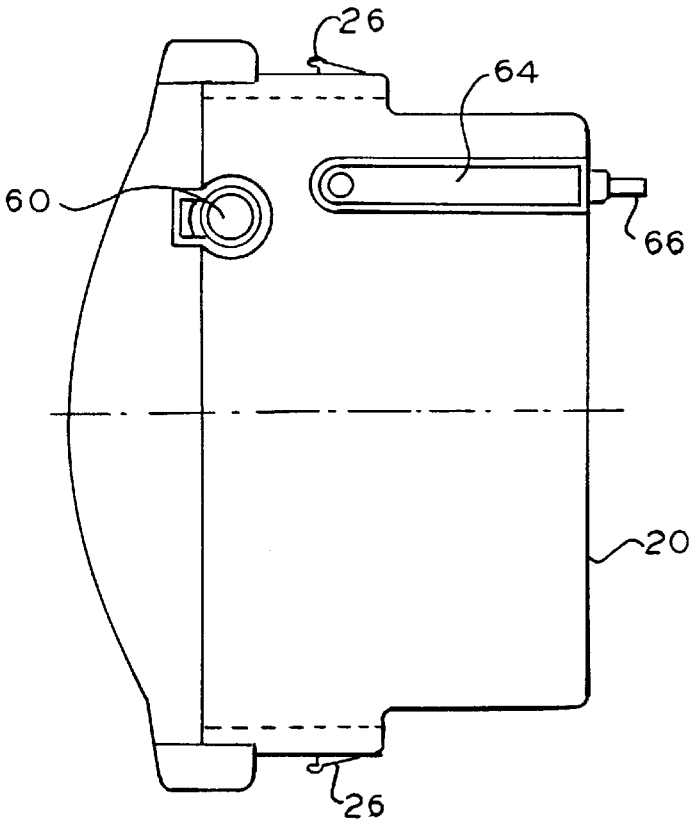
FIG. 4
FIG. 5
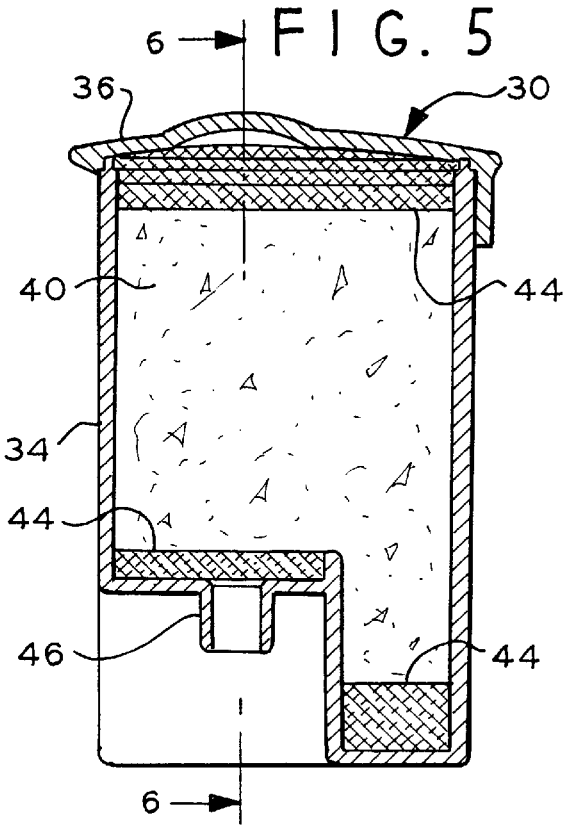
FIG. 6
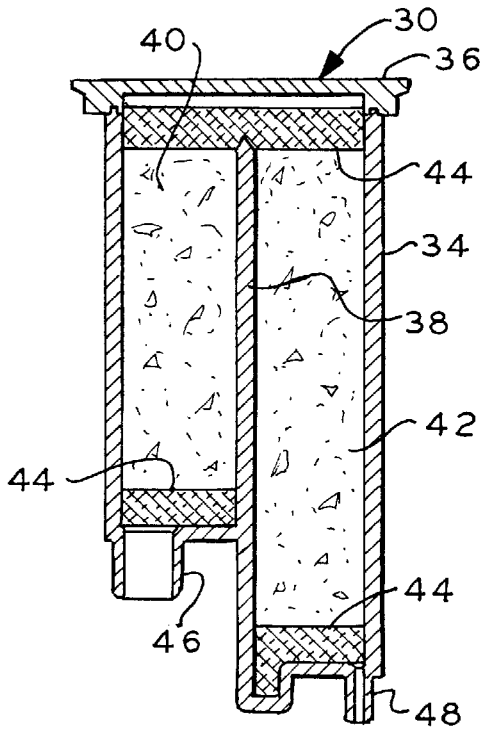

STEAM IRON STATION

BACKGROUND OF THE INVENTION

1. Field of the Invention

The present invention relates to steam irons, and in particular, to stations that cooperate with steam irons.

2. Description of Related Art

A conventional steam iron has an internal reservoir that feeds water to a steam chamber in an electrically heated soleplate, in order to produce steam from the iron. Typically, water dripped or sprayed into the steam chamber then passes through a channel in the soleplate in order to complete the vaporization and/or to heat the resulting steam. Conventional irons have limits on their steam producing capacity based on the size of the soleplate, which limits the length of the channel from the steam chamber.

Also conventional irons rely on gravity to feed water from the reservoir when the iron is horizontal. Such irons cannot apply steam when the iron is upright or vertical. Such a capability is important when the user wants to apply steam to a hanging garment to coax out wrinkles or to prepare a garment for ironing.

Another disadvantage with these arrangements is the weight added to the iron by the water reservoir. Moreover, since the reservoir cannot be too large, it must be periodically refilled. Such refilling can be a great inconvenience for long ironing sessions.

Another difficulty with conventional irons is the tendency of mineral deposits to clog various passages in the iron that normally conduct water or steam.

In U.S. Pat. No. 4,535,556 water from an external reservoir is pressurized by a pump so that a valve can spray water into a steam chamber. In the embodiment of FIG. 3 a pump keeps up pressure to a valve, but the pump and the entire reservoir assembly would need to be carried to a faucet in order to fill the reservoir. In the embodiment of FIG. 1, a pump is switched on and off by a control at the iron, but the pump is a unit separate from the reservoir and the iron, with separate hoses running to each.

In U.S. Pat. No. 3,130,507 an iron has an internal water container. Water can be supplied either from this container or from a hose fed from a faucet (the hose can also fill the water container). Cloth can be dampened by depressing a button to open a valve that allows water into a steam generating chamber, so that a spray is emitted from openings 25 and 23. Another valve can be manually adjusted to allow water into a steam generating chamber in order to supply steam to outlets 35. This unit has neither a pump nor an external reservoir and therefore lacks the ability to operate at a distance from a faucet. Also, its internal reservoir will make the iron relatively heavy.

In U.S. Pat. No. 5,315,773 an ironing head can be placed in a rest assembly that includes couplings that supply water and electrical power to the ironing head. This rest assembly is part of a larger structure that includes a water tank and an ironing table. A pump in the rest assembly supplies water if a water reservoir inside the ironing head is low. The internal reservoir in the ironing head adds substantially to its weight. Also, no power line or hose is connected to the ironing head. Instead the ironing head must be periodically returned to the rest assembly in order to receive additional water and electrical power.

U.S. Pat. No. 5,414,945 shows a base for receiving an iron and a water cassette. The water cassette does not have plumbing to fill the iron when mounted on the base.

In U.S. Pat. No. 5,428,910 an iron is supplied with water from an external reservoir having a pump that is controlled by a control at the iron. Water from the external reservoir is supplied through a valve to a steam chamber. Water from an internal reservoir is supplied through another valve.

In U.S. Pat. No. 3,599,357 water is either dripped into one chamber for low velocity steam, or pumped into another chamber for high velocity steam. The steam so generated follows a tortuous backward path in a soleplate, and then a distribution path in the soleplate cover to feed steam holes.

See also U.S. Pat. Nos. 4,197,664; 4,870,763; 4,920,668; and 5,170,577, as well as design Pat. Nos. D374,322 and D380,068.

SUMMARY OF THE INVENTION

In accordance with the illustrative embodiments demonstrating features and advantages of the present invention, there is provided a steam iron station having a removable tank mounted in a case. Also included is a conduit adapted to be coupled to the steam iron. The steam iron station also has a pump mounted in the case and coupled to the tank and the conduit for discharging to the conduit, liquid drawn from the tank.

According to another aspect of the invention, a steam iron station includes a case having a tank with an outlet. Also included is a removable filter having an intake. The filter is mounted at the case to communicate with the tank. The steam iron station also has a conduit adapted to be coupled to the steam iron. Also included is a pump mounted in the case and coupled to the filter and the conduit for discharging to the conduit, liquid drawn through the filter from the tank.

According to still another aspect of the invention, a steam iron includes an electrical heater mounted in a soleplate. The soleplate has an upper channel and a lower channel. The upper and the lower channels each have a forward flowing and a backward flowing branch. The upper channel serially communicates with the lower channel. The iron also has a duct for delivering liquid to the upper channel.

By employing apparatus of the foregoing type, an improved steam iron and steam iron station is achieved. In a preferred embodiment, a steam iron station has a case with a heat resistant upper deck acting as a rest for a steam iron. A removable tank can be attached to the case with a pair of latches. Being removable, the tank can be carried to a tap, where a preferred filling cap can be removed to allow filling of the tank.

Preferably, a removable filter is mounted in the tank of the case to eliminate minerals dissolved in the water in the tank. The filter can have an intake that connects to a preferred valve located adjacent a cavity designed to hold the filter. This valve can close when the filter is removed in order to stop water from flooding the vacated filter cavity.

An outlet from the filter preferably feeds a pump that is mounted inside the case of the steam iron station. The preferred pump has a solenoid-operated piston controlled by a pump controller inside the case. In one embodiment, the pump controller had a capacitive timing circuit that drove a D-type flip flop to operate a thyristor-controlled pump.

In a preferred embodiment, the pump can supply water to a steam iron in either a continuous or enhanced (super steam) mode. In both modes, the pump reciprocates during an active interval, and stops reciprocating during a subsequent, quiescent interval. In the preferred embodiment, the quiescent interval is shortened to increase the pumping volume during the enhanced mode.

In either event, the pump enables steam generation, even if the steam iron is held upright, as when coaxing wrinkles from a hanging garment. Unlike steam irons relying on gravity to supply water from a reservoir, the pump provides a positive, reliable supply.

The preferred steam iron has a soleplate with a lower channel on its underside and an upper channel on its top side. The lower and the upper channels each have a backward flowing branch and a forward flowing branch. The forming of channels on opposite sides of the soleplate increases the length of the path available for vaporizing water and heating steam.

BRIEF DESCRIPTION OF THE DRAWINGS

The above brief description as well as other objects, features and advantages of the present invention will be more fully appreciated by reference to the following detailed description of presently preferred but nonetheless illustrative embodiments in accordance with the present invention when taken in conjunction with the accompanying drawings, wherein:

FIG. 4 is a bottom view of the tank of FIG. 1, removed from the station;

FIG. 5 is a cross-sectional view of the filter of FIG. 3;

FIG. 6 is a cross-sectional view of the filter taken along line 6—6 of FIG. 5;

DETAILED DESCRIPTION OF THE PREFERRED EMBODIMENTS

Figure 1:
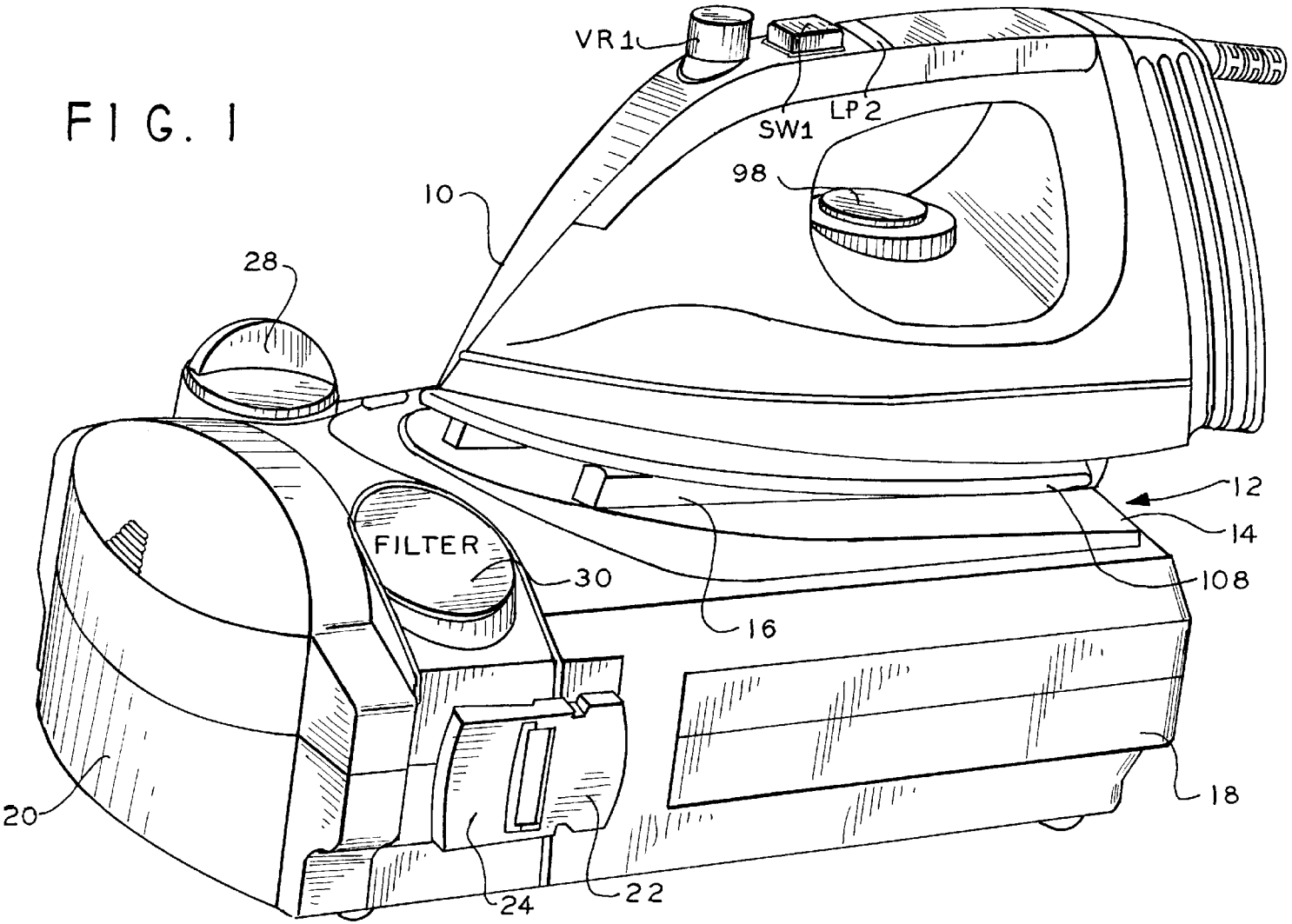
FIG. 1 is a perspective view of a steam iron resting atop a steam iron station, in accordance with principles of the present invention.
Figure 2:
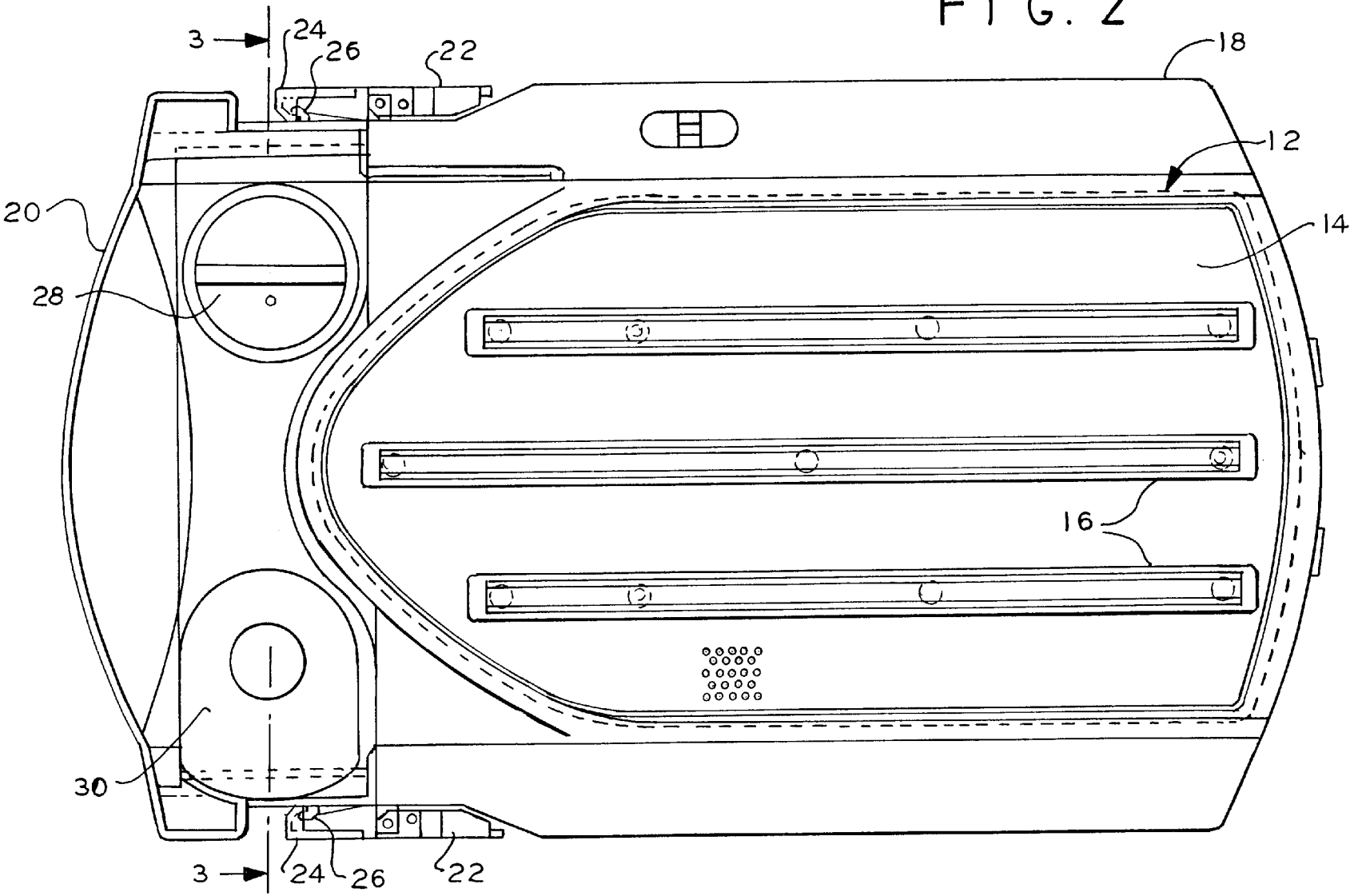
FIG. 2 is a top view of the steam iron station of FIG. 1.
Figure 3:
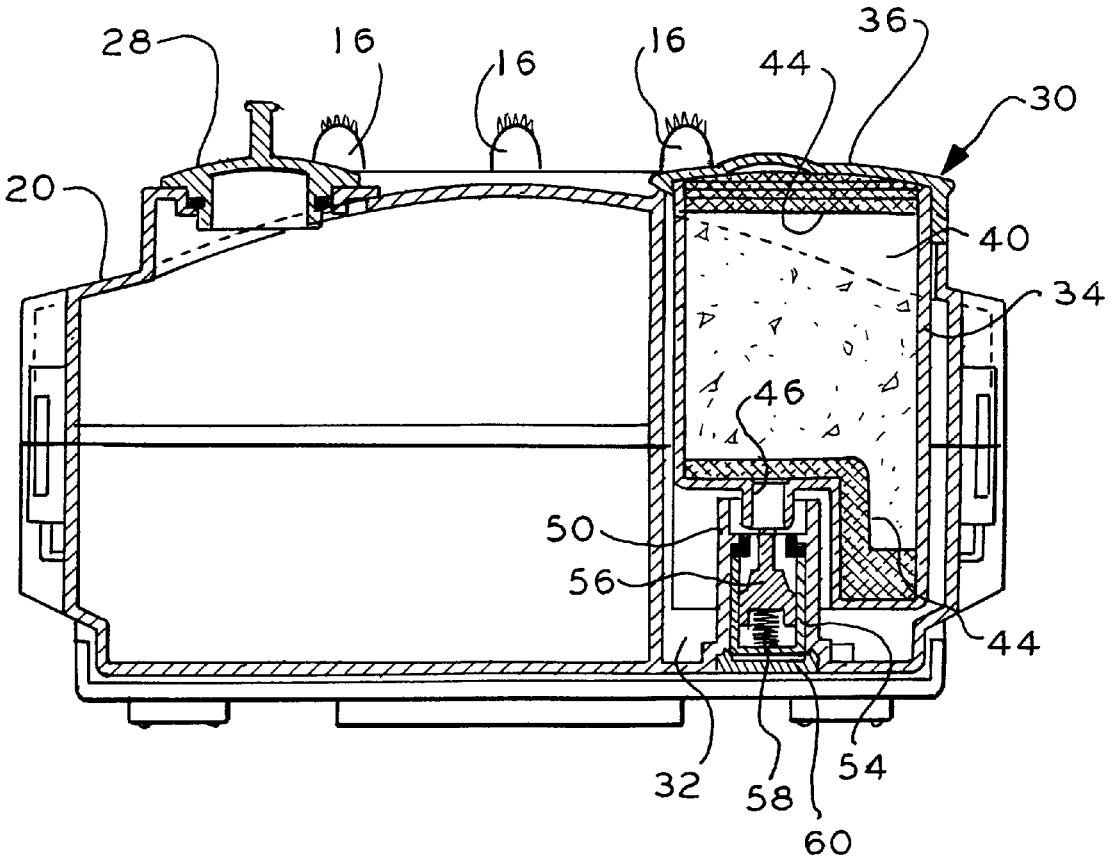
FIG. 3 is a cross-sectional view of the steam iron station, taken along line 3—3 of FIG. 2.

Referring to FIGS. 1 and 2, steam iron 10 is shown resting atop a heat resistant upper deck 12 of a steam iron station. Upper deck 12 comprises a platform 14 with heat resistant ribs 16. The steam iron station includes a case 18 that is preferably made of molded plastic, but in other embodiments, can be made of sheet metal or other materials.

One end of case 18 has a recess designed to receive removable tank 20. Tank 20 can be secured in place by a pair of toggle latches 22, acting as a latch means. Latches 22 are pivotally mounted on case 18 and each have a catch 24 for engaging lugs 26 on tank 20. Tank 20 may be a plastic, molded container with an opening stopped by a removable filling cap 28. Mounted in a cavity in tank 20 is a removable filter 30.

Referring to FIGS. 3–6, filter 30 is shown mounted inside cavity 32 of tank 20. Filter 30 comprises a cartridge 34 covered by a lid 36. Cartridge 34 is divided into two compartments 40 and 42, separated by a baffle or weir 38 to form an upstream path and downstream path, respectively. The compartments 40 and 42 are filled with an appropriate filter material for eliminating dissolved minerals. The filter material 40 is a salt or other substance chosen to remove minerals such as calcium in order to soften the water. Preferably, the filter 30 brings the concentration of calcium carbonate $CaCO_3$ to less than 50 mg/L. Compartment 40 is shown supplied by an intake 46, while compartment 42 is drained by an outlet 48. The opposite ends of compartments 40 and 42 are packed with a foam material 44 to prevent migration of the filter material out of the respective compartments.

Figure 8:
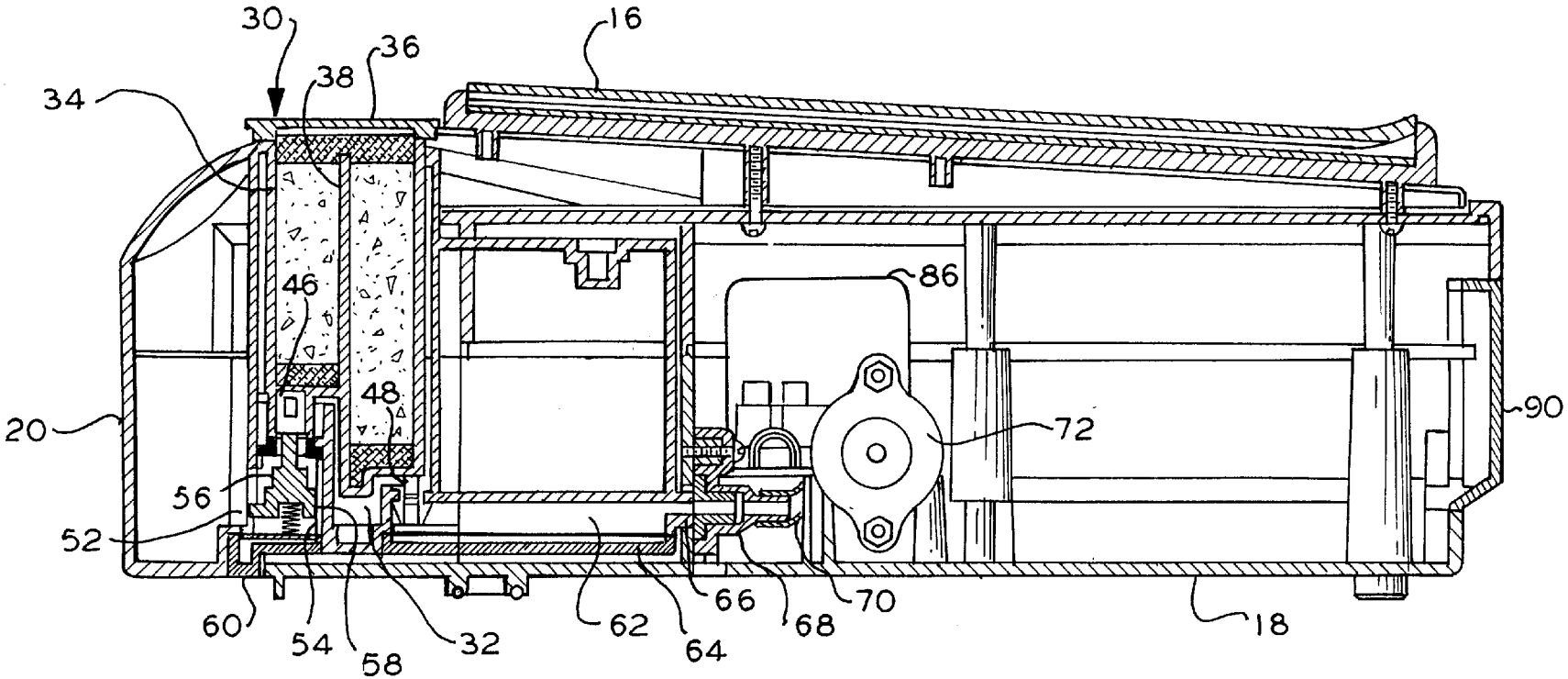
FIG. 8 is a cross-sectional, elevational view taken along line 8—8 of FIG. 7.

A vertical chute 50 molded in the underside of tank 20 has a side hole 52 (FIG. 8) communicating with the interior of the tank. Mounted inside chute 50 is a valve means comprising a cylinder 54 and piston 56. Cylinder 54 has a hole matching previously mentioned hole 52 (FIG. 8). Compression spring 58 is mounted between piston 56 and the floor of cylinder 54 to urge piston 56 upwardly. Intake 46 of filter 38 is designed to normally depress piston 56 to open the valve means and allow water from inside tank 20 to flow through filter 30. A plug 60 is shown pressed into the underside of tank 20 to hold cylinder 54 in place.

Figure 7:
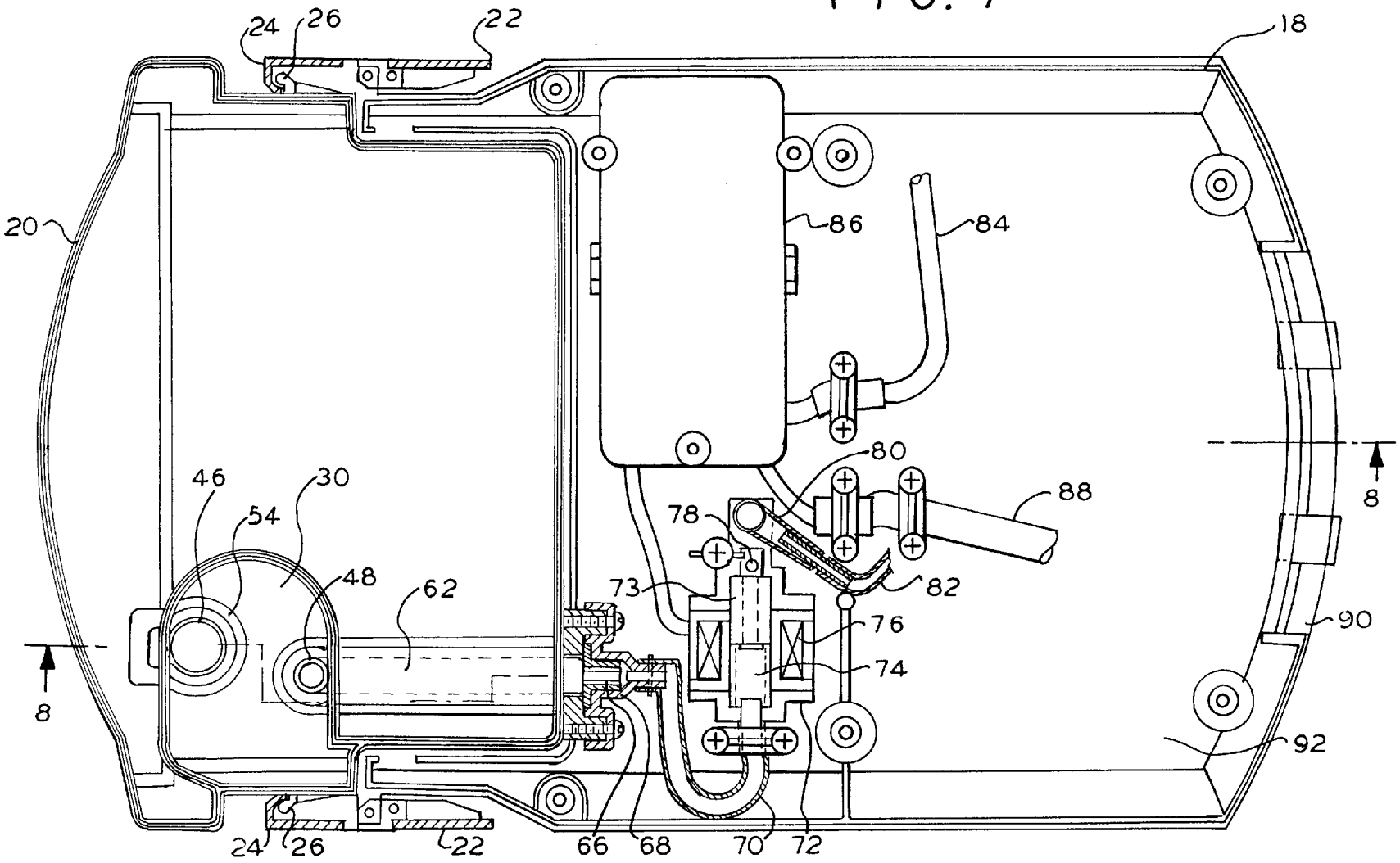
FIG. 7 is a cross-sectional, plan view of the steam iron station of FIG. 2.

Referring to FIGS. 4, 7 and 8, the outlet 48 of filter 30 is shown fitting into an opening in tunnel 62. Tunnel 62 is a concavely molded depression in the underside of tank 20, which is closed by a bottom plate 64.

Tank outlet 66 is shown connecting to a female end of fitting 68, which is screwed in place to bosses on the inside of case 18. The male end of fitting 68 connects through hose 70 to pump 72. Pump 72 has an axially reciprocating piston 74 mounted within a pump cavity 73. A check valve 78 is mounted at the outlet of pump cavity 73. A solenoid coil 76 mounted around pump cavity 73 can receive pulses of current in order to pull piston 76 towards check valve 78 and perform pumping in a known manner.

The outlet of pump 72 is shown connecting through pipe 80 to a conduit 82, which can be bundled with electrical wires 84 that connect to the previously mentioned steam iron.

A pump controller 86 is shown connected to pump 72 for controlling it in a manner to be described presently. Controller 86 receives power from cable 88 for distribution to pump 72, as well as the steam iron through cable 84. Power cable 88 can be stored inside case 18 by opening door 90 and stuffing cable 88 inside the externally accessible compartment 92 inside the case.

Figure 9:
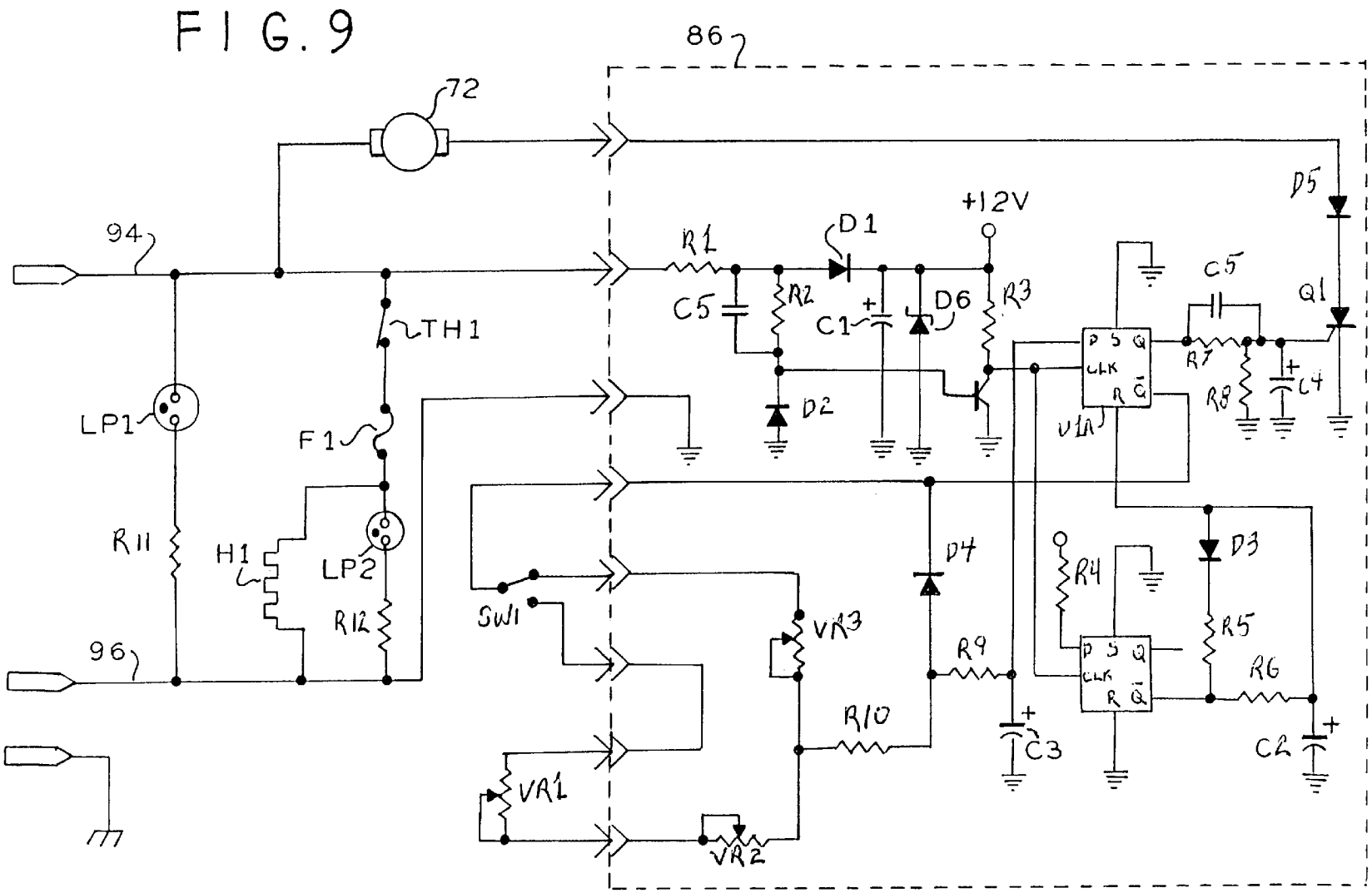
FIG. 9 is a schematic diagram of the pump controller shown in FIG. 7.

Referring to FIG. 9, the circuitry of the previously mentioned pump controller 86 is shown connecting to pump 72. Alternating current is supplied to controller 86 through live line 94 and neutral line 96, which lines are shunted by station pilot light LP1 and serial resistor R11.

Serially connected across lines 94, 96 are variable thermostat TH1, fuse F1, and heater H1, which are all located in the previously mentioned steam iron. Also located in the steam iron is the serial combination of pilot light LP2 and resistor R12, which is connected in parallel with heater H1.

A regulated 12 volts is produced by the parallel combination of filter capacitor C1 and Zener diode D6, which receives positive current pulses from the cathode of rectifier D1, whose anode connects through resistor R1 to high line 94. This 12 volts is supplied through collector resistor R3 to common emitter transistor Q2, whose base connects to the cathode of diode D2, whose anode is grounded. The positive switching pulses applied to the base of transistor Q2 are supplied through resistor R2, which connects between the anode of diode D1 and the cathode of diode D2.

Switch SW1, located in the previously mentioned steam iron, is shown in its enhanced steam (super steam) position. This is a momentary contact position and the user must keep his or her thumb pressed against the switch SW1 to maintain this enhanced steam mode. The switch SW1 connects to the output $\overline{Q}$ of D-type flip flop U1A. Output $\overline{Q}$ is initially high because the input D of flip U1A remains initially low by virtue of being connected to initially discharged, shunting capacitor C3. With the wiper of switch SW1 pressed to the 1*a* position, current from output $\overline{Q}$ flows through switch SW1, variable resistor VR3, and resistors R10 and R9 to charge capacitor C3 in about 250 milliseconds, in order to convert the D input of flip flop U1A. Accordingly, the next trigger applied by transistor Q2 to the clock input CLK will set flip flop U1A. The collector of transistor Q2 regularly produces such triggering pulses in synchronism with power line 94, which connects through resistors R1 and R3 to the base of transistor Q2.

With flip flop U1A set, output $\overline{Q}$ is low and can discharge capacitor C3 through resistor R9 in about 10 milliseconds. This discharge path is accomplished by diode D4, whose cathode connects to output $\overline{Q}$, and whose anode connects through resistor R9 to capacitor C3.

Before capacitor C3 discharges and while flip flop U1A is still set, output Q is high to supply a positive signal through resistor R7 to the gate of SCR (Silicon Controlled Rectifier) Q1, whose cathode is grounded. Pump 72 is connected between power line 94 and the anode of rectifier D6, whose cathode connects to the anode of SCR Q1. While the gate of SCR Q1 is high, positive half cycles of current can flow through pump 72 and through rectifier D6 and SCR Q1. This energizes the previously mentioned solenoid coil 76 (FIG. 7) to reciprocate piston 74 at the same frequency as the power line.

Eventually however, capacitor C3 is discharged to apply a low signal to the D input of flip flop U1A. Accordingly, flip flop U1A will be reset by the next trigger applied to input CLK. Consequently, output Q of flip flop U1A will apply a low signal to the gate of SCR Q1 to stop current flowing through pump 72. The cycle can repeat by recharging capacitor C3 as before. If however, the wiper of switch SW1 is now moved to the opposite contact, 1*b*, charging current flows through variable resistors VR1 and VR2 and resistors R10 and R92 to charge capacitor C3. Variable resistors VR1 and VR2 have a much higher resistance value and can be adjusted to increase the charging time of capacitor C3 by zero to six minutes.

Figure 10A:
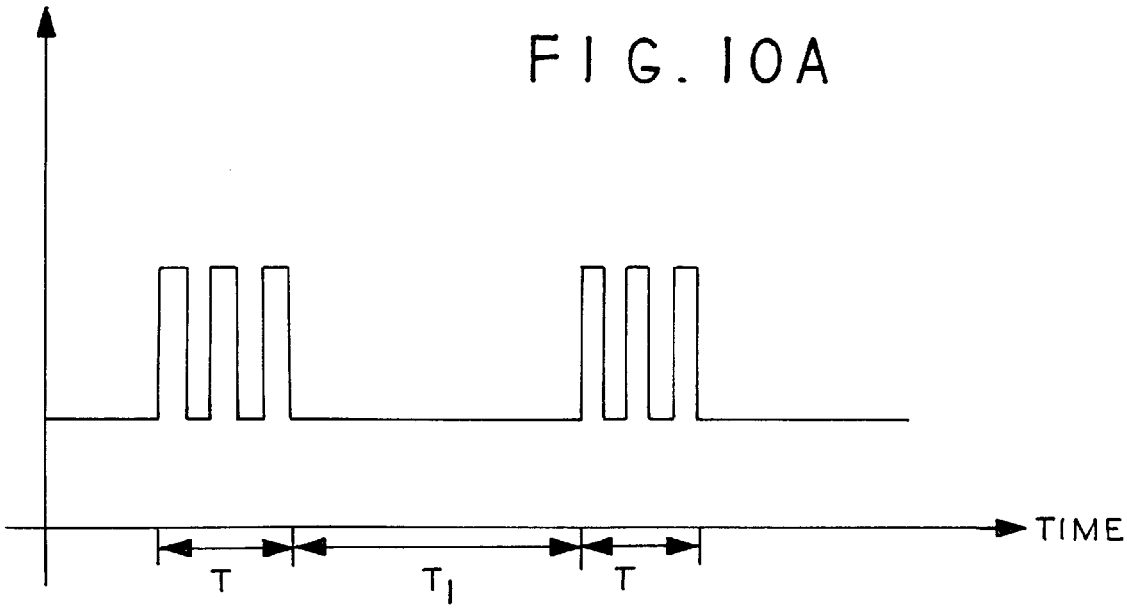
FIGS. 10A and 10B are timing diagrams associated with the pump controller of FIG. 9.
Figure 10B:
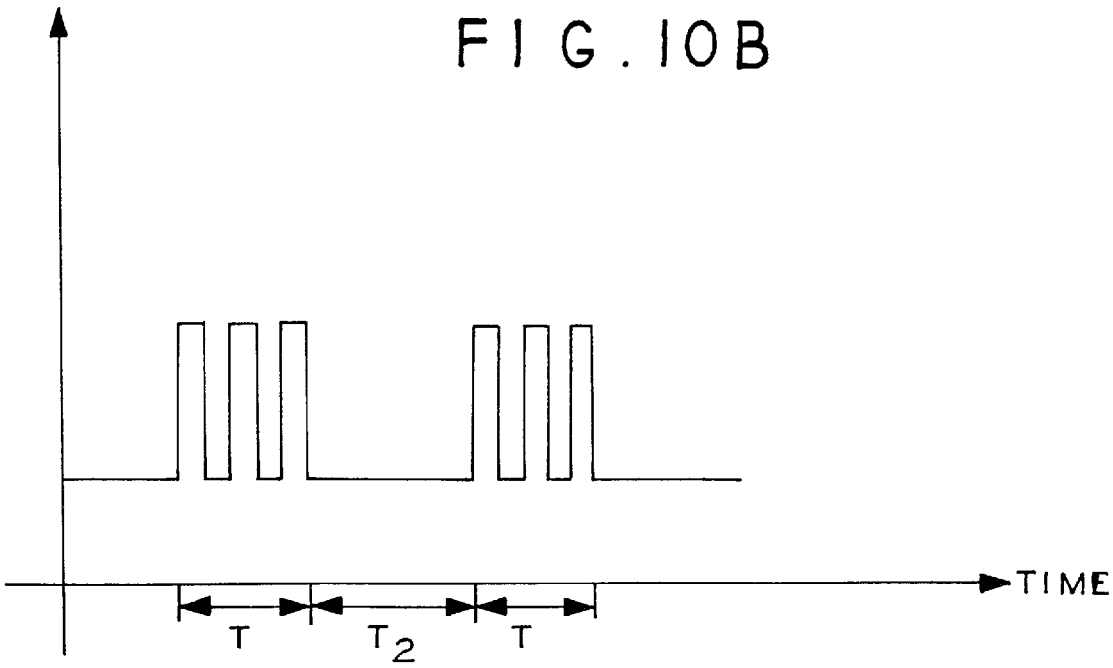
Figure 11:
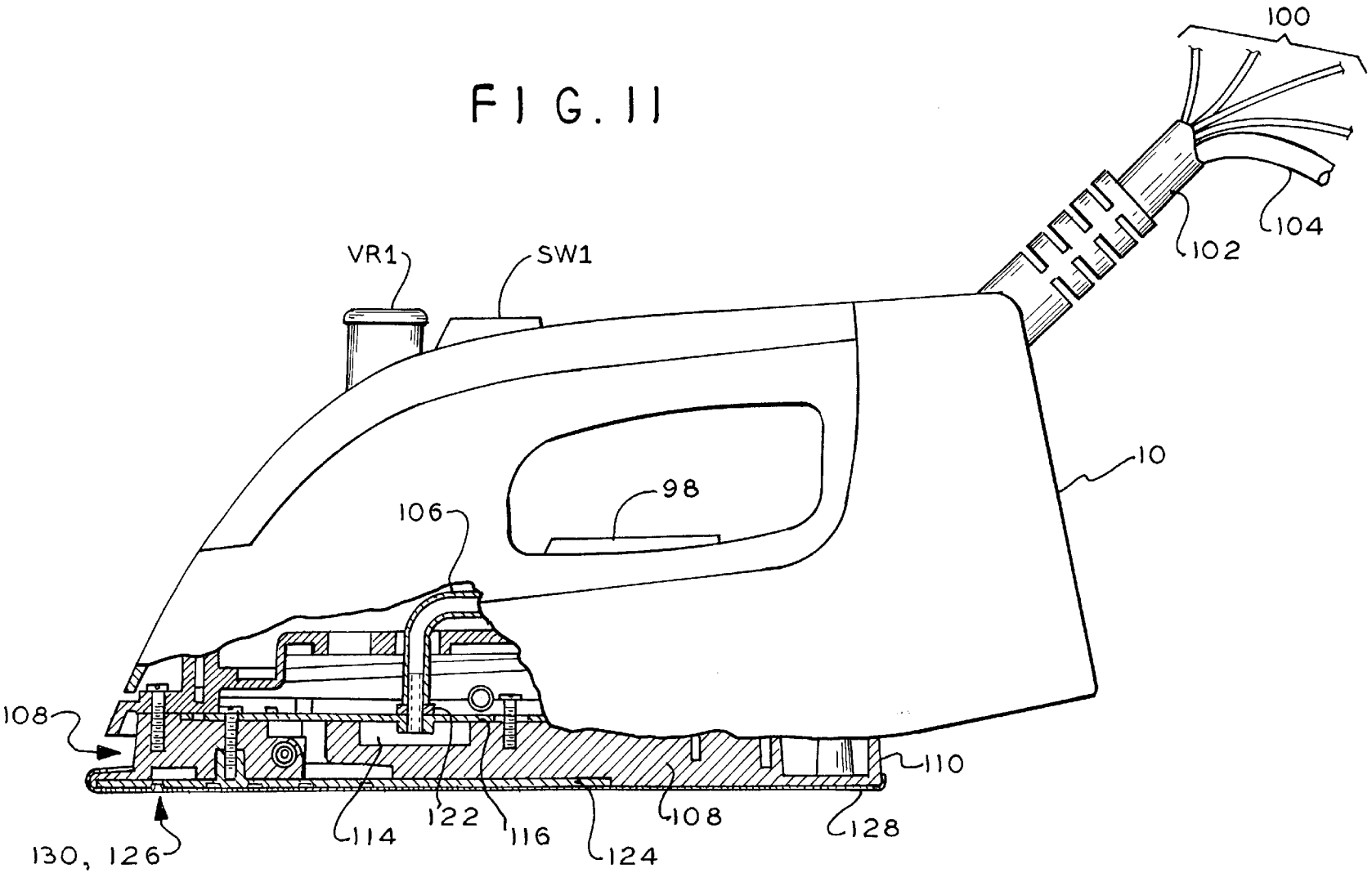
FIG. 11 is a side view, partly in section, of the steam iron of FIG. 1.
Figure 12:
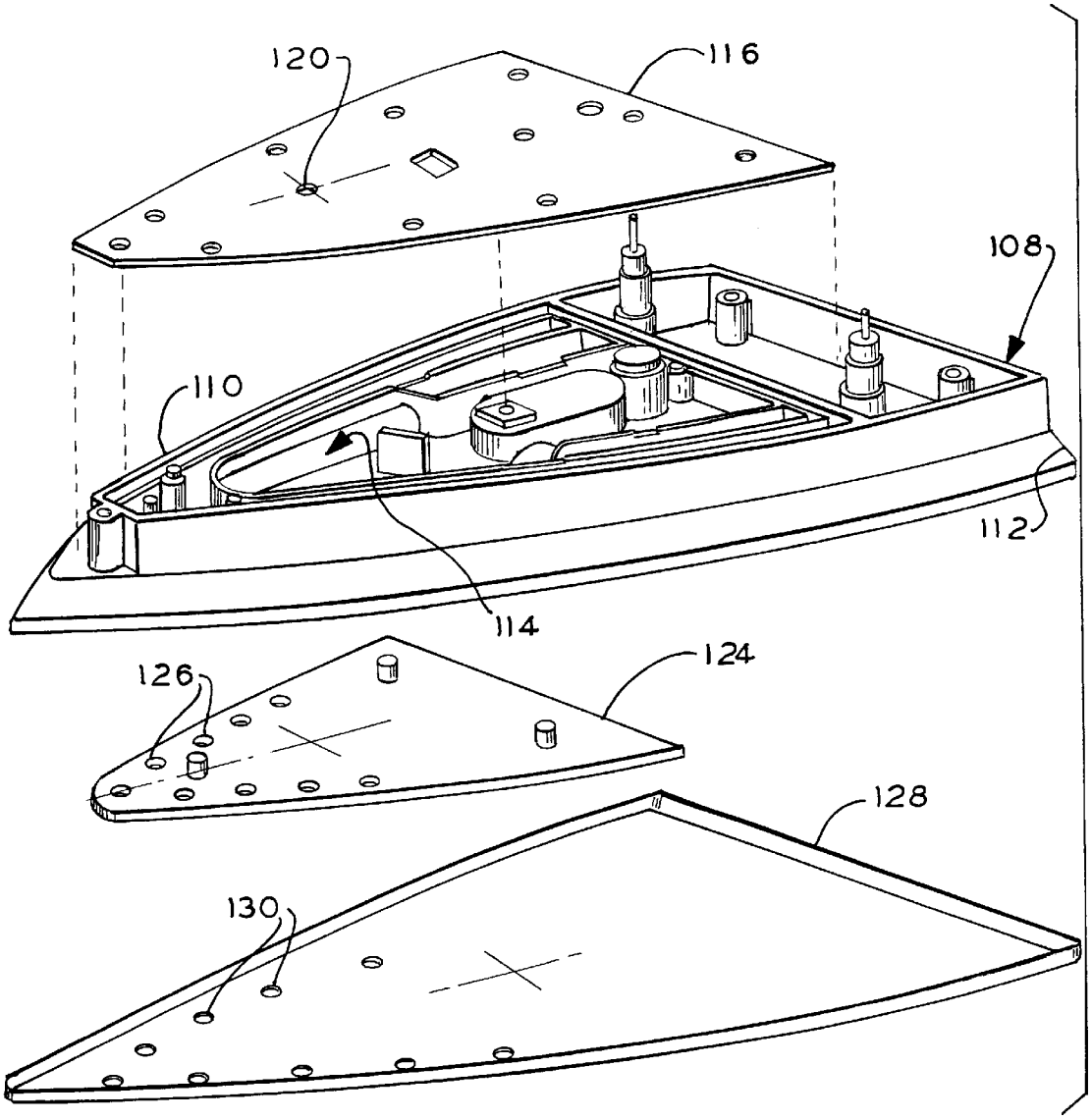
FIG. 12 is an exploded view of the soleplate and its associated hardware in the steam iron of FIG. 11.

Referring to FIG. 10A, this longer charging interval is indicated as interval T1. During the enhanced (super steam) mode the charging interval is the shorter interval T2 as shown in FIG. 10B. In either mode, the shorter discharging interval is indicated as interval T. Interval T is shown with the duration sufficient to produce three current pulses in synchronism with the power line, although a different number of pulses over a different duration may be employed in alternate embodiments. Similarly, the charging intervals T1 and T2 may be made longer or shorter depending upon the specific application.

If the wiper of switch SW1 is placed in the middle (unconnected) position, capacitor C3 is never recharged. Therefore, the D input of flip flop U1A remains low and this flip flop remains reset. Consequently, SCR Q1 remains switched off and pump 72 remains inactive.

Referring to FIGS. 1 and 11–14, mounted at the top edge of the steam iron 10 are the previously mentioned pilot light LP2, and two manual controls, namely, the previously mentioned steam selector switch SW1, and the variable resistor VR1 for adjusting the continuous steam setting. A knob 98 is mounted inside the hand hole of iron 10 for adjusting the previously mentioned thermostat (variable thermostat TH1 of FIG. 9). An external power cord 100 is shown routed through sleeve 102 to the interior of steam iron 10. Also, an external hose 104 is also routed through sleeve 102 to connect to an internal duct 106. Duct 106 and hose 104 communicate with the outlet of previously mentioned pump 72 (FIG. 7).

A soleplate 108 is shown with a surrounding wall 110 integral with a plate 112 having a bevelled outer edge. Previously mentioned electrical heater H1 is shown embedded in soleplate 108 and leading to connection standards 132. Soleplate 108 also has a steam producing chamber 114. Soleplate 108 is covered by a top plate 116 having an inlet hole 120 adapted with a fitting 122, which is coupled to duct 106. The underside of soleplate 108 is fitted with a bottom plate 124 having a number of steam holes 126. Soleplate 108 and bottom plate 124 are covered with a metal shroud 128 to provide a continuous ironing surface interrupted by steam holes 130.

Figure 13:
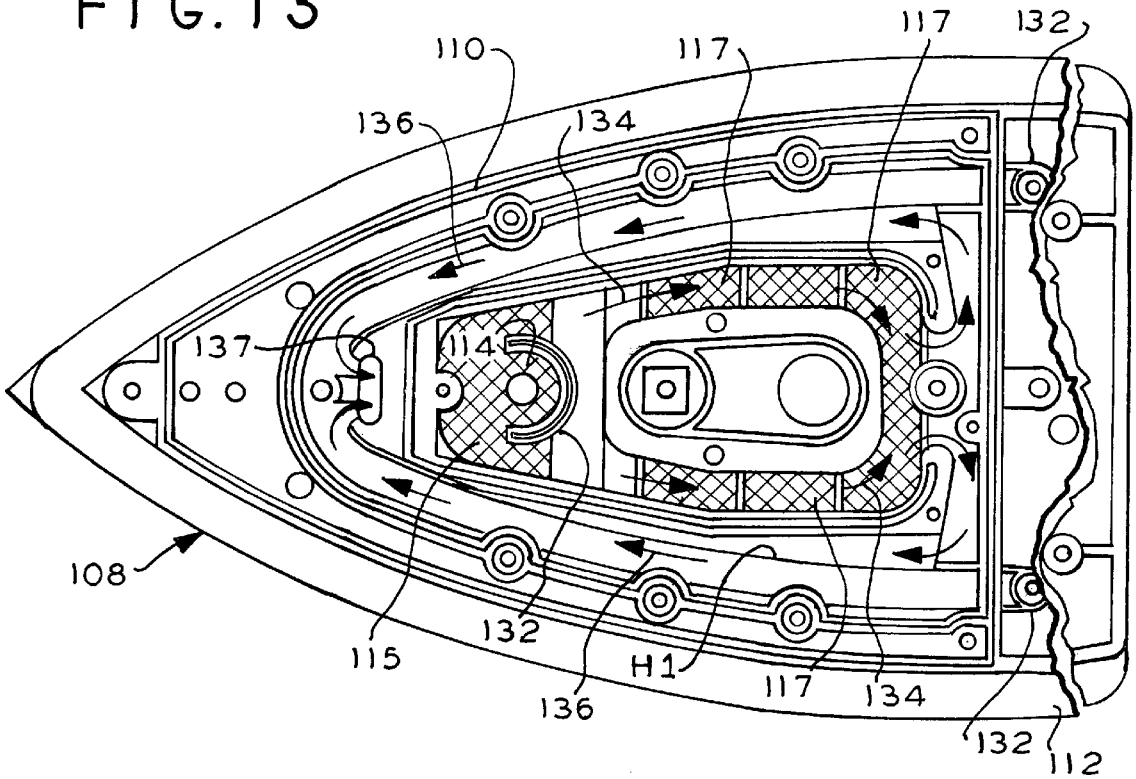
FIG. 13 is a top view of the soleplate of FIG. 12.

Referring to FIG. 13, water dripping into chamber 114 will go around the diverting wall 132 to flow along the backward flowing branch 134, which is part of an upper channel. Backward flowing branch 134 communicates with a forward flowing branch 136, which is also part of the upper channel. Forward flowing branch 136 leads to a transfer hole 137 that communicates to a lower channel on the underside of soleplate 108.

The surface at the steam generating chamber 114 has a grid of raised ridges 115. A similar grid of raised ridges 117 is formed in backward flowing branch 134. These cross-textural surfaces increase the overall surface area to enhance the steam generating capacity of the chamber. Also, area 115 is covered with a steam generation paint chosen to enhance vaporization. Paint of this type can be obtained from Weilburger (Far East) Ltd. as Hydrotherm Paint 1210. This paint has a combination of fillers and binders to ensure an even formation of steam, while preventing drop formation at the soleplate.

Figure 14:
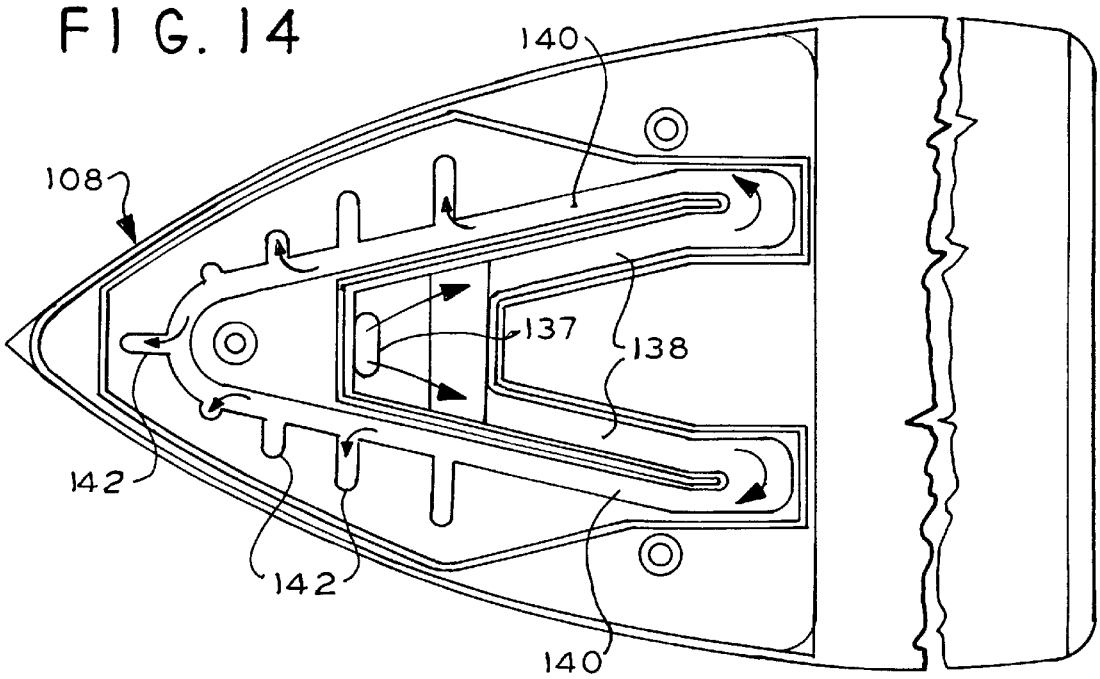
FIG. 14 is a bottom view of the soleplate of FIG. 13.

Referring to FIG. 14, the lower channel includes a backward flowing branch 138 communicating with a forward flowing branch 140. Branch 140 terminates in nine stubs 142 that communicate with steam holes (steam holes 126 in bottom plate 124 of FIG. 12).

To facilitate an understanding of the principles associated with the foregoing apparatus, its operation will be briefly described. Tank 20 can be filled by pulling latches 22 to release catches 24. Tank 20 is then removed from the recess of case 18. Next, cap 28 can be removed and the tank 20 can be filled at a water tap, or in some other fashion. When the tank is filled, water does not spontaneously spill from outlet 66. To flow through outlet 66 under the force of gravity, water must be overfilled to spill over weir 38 (FIG. 8). Thus if the tank 20 is not overfilled, water will not spill through outlet 66. Once filled, cap 28 is replaced on tank 20, and the tank is installed again in case 18, using latches 22 to secure the tank.

If filter 30 must be replaced or inspected, it is pulled out of filter cavity 32, which causes spring 58 to drive piston 56 upwardly and close the valve means. Accordingly filter cavity 32 will not be flooded when filter 30 is removed. When the same or a replacement filter is reinstalled, its intake 46 depresses piston 56 to reopen the valve means.

Power cord 88 (FIG. 7) can be removed from chamber 92 by opening door 90. Cord 88 can then be plugged into a power outlet (not shown). This immediately conveys power through cord 84, which connects through cable 100 (FIG. 11) to the heater H1 (FIG. 13) of the steam iron. The temperature of the steam iron 10 can be adjusted by turning knob 98 (FIG. 1) to adjust the variable thermostat TH1 (FIG. 9).

If switch SW1 is slid into the position for continuous steam, pump 72 is activated so that piston 74 (FIG. 7) reciprocates during interval T (FIG. 10A), followed by inactive interval T1, whose duration can be adjusted by variable resistor VR1 (FIGS. 1 and 9). Consequently, pump 72 draws water from tank 20 through filter 30, through its upstream compartment 40 and downstream compartment 42. Water drawn through filter 30 flows through passage 62 and hose 70 to the outlet side of check valve 78. Water under pressure then flows through pipe 80 and conduit 82 into hose 104 (FIG. 11) of steam iron 10. Water then flows through conduit 106 into steam generating chamber 114.

The steam enhancing surface 115 (FIG. 13) is heated by electrical heater H1 to quickly generate steam. Steam and any residual water leaving chamber 114 flow through backward paths 134 where the special surfaces 117 further enhance steam generation. Steam then flows along forward paths 136, eventually passing through transfer hole 137 to the underside of soleplate 108 (FIG. 14). Steam passing through the hole 137 flows through backward paths 138 and forward paths 140 before reaching stubs 142 and exiting through holes 126 and 130 of elements 124 and 128, respectively.

In some instances, it may be desirable to hold steam iron 10 in an upright or vertical position next to a garment that may be suspended on a hanger. The pump 72 together with the backward and forward paths 134, 136, 138, and 140 ensure a strong continuous flow of steam, even when the steam iron 10 is held upright. In fact, in this upright position, the operator may choose to generate an enhanced steam flow by pushing switch SW1 into the momentary, "super steam" position, which decreases the inactive pump interval (T2) thereby generating additional steam. This additional steam flow can also be initiated when the steam iron 10 is oriented horizontally while pressed on a garment.

Alternatively, switch SW1 can be placed at its neutral position to inactivate pump 72 and stop all steam generation. This latter position may be useful when the operator is no longer ironing and rests steam iron 10 on platform 12.

It is appreciated that various modifications may be implemented with respect to the above described, preferred embodiments. The size and shape of the water tank and the case of the steam station can be altered, depending upon the desired capacity, strength, size, or for aesthetic reasons. In addition, the tank may be secured to the case by different latches, or may not be latched at all. Also, the filter can be placed in a variety of locations at the tank or case, and may use a variety of filter materials of different volumes. Moreover, the pump may employ a different pumping mechanism and may be located in different positions inside or alongside the case. Additionally, the fittings connecting the various hydraulic components may use different seals, connections, or fittings, depending upon the desired sealing properties, integrity etc. Also, the circuit for driving the pump can employ a variety of analog or digital circuits and may in some cases provide a continuous drive, as opposed to a pulsed drive. Furthermore, the soleplate can be composed of a different number of components than that illustrated. Moreover, the forward and backward paths of the soleplate can be modified into a number of serpentine passages, depending upon the desired length, capacity, etc.

Obviously, many modifications and variations of the present invention are possible in light of the above teachings. It is therefore to be understood that within the scope of the appended claims, the invention may be practiced otherwise than as specifically described.

What is claimed is:

1. A steam iron station comprising:

a case;

a removable, fixedly held tank mounted in said case;

a conduit adapted to be coupled to a steam iron; and a pump mounted in said case and coupled to said tank and said conduit for discharging to said conduit liquid drawn from said tank.

2. A steam iron station according to claim 1 wherein said case comprises:

a heat resistant, upper deck adapted to support a steam iron.

3. A steam iron station according to claim 1 comprising:

manually operable latch means for releasably securing said tank to said case.

4. A steam iron station according to claim 3 wherein said removable tank has a removable filling cap.

5. A steam iron station according to claim 1 wherein said removable tank has an outlet, said station comprising:

a filter having an intake and being serially connected to the outlet of said tank for filtering liquid leaving said tank through said outlet.

6. A steam iron station according to claim 5 comprising:

manually operable latch means for releasably securing said tank to said case, said removable tank having a removable filling cap, said case having a heat resistant, upper deck adapted to support a steam iron.

7. A steam iron station according to claim 5 wherein said filter comprises:

a cartridge containing a filter material; and a baffle mounted in said cartridge for dividing it into an upstream and downstream path.

8. A steam iron station according to claim 7 wherein said baffle acts as a weir for restricting draining through said outlet upon removal of said removable tank.

9. A steam iron station according to claim 5 wherein said filter is removable, said tank comprising:

valve means mounted at said intake of said filter for stopping flow thereto upon removal of said filter from said tank.

10. A steam iron station according to claim 9 wherein said filter comprises:

a cartridge containing a filter material; and a baffle mounted in said cartridge for acting as a weir and for dividing the cartridge into an upstream and downstream path.

11. A steam iron station according to claim 1 wherein said pump comprises a piston.

12. A steam iron station according to claim 11 comprising:

a pump controller for reciprocating said piston for a predetermined burst interval.

13. A steam iron station according to claim 11 wherein said pump is electrically operable, said station comprising:

a pump controller for plurally reciprocating said piston for a predetermined burst interval, followed by a quiescent interval.

14. A steam iron station according to claim 13 wherein said pump controller is manually operable to change in duration said quiescent interval.

15. A steam iron station according to claim 13 wherein said pump controller is continuously, manually adjustable to change said quiescent interval.

16. A steam iron station according to claim 13 wherein said pump controller is manually operable to shorten in duration said quiescent interval by a predetermined discrete amount in order to temporarily augment pump output.

17. A steam iron station according to claim 13 wherein said pump controller comprises:

a capacitive timing means for establishing said burst and said quiescent intervals by charging and discharging at different rates.

18. A steam iron station according to claim 17 wherein said pump controller comprises:

a switching means adapted to be coupled to a source of alternating current for applying a plurality of unidirectional current pulses to said pump during said burst interval.

19. A steam iron station according to claim 1 comprising:

a steam iron having a soleplate with a steam producing chamber coupled to said conduit.

20. A steam iron station according to claim 19 wherein said steam iron comprises a duct communicating between said conduit and said steam producing chamber for carrying liquid without diversion out of said duct for storage inside said steam iron.

21. A steam iron station according to claim 19 wherein said steam iron includes:

a manual control coupled to said pump for changing its rate of discharge.

22. A steam iron station according to claim 21 wherein said steam iron includes:

an external power cord; and an external hose coupled to said conduit, said power cord and said hose being bundled together.

23. A steam iron station according to claim 22 wherein said case comprises:

an externally accessible compartment sized to store most of said power cord and said hose.

24. A steam iron station according to claim 19 wherein said steam iron includes:

a manual control coupled to said pump for continuously changing its rate of discharge.

25. A steam iron station according to claim 19 wherein said steam iron includes:

a manual control coupled to said pump for selectively changing its rate of discharge between two discrete values.

26. A steam iron station according to claim 19 comprising:

an electrical heater mounted in said soleplate, said soleplate having an upper channel and a lower channel, said upper and said lower channels each having a forward flowing and a backward flowing branch, said upper channel serially communicating with said lower channel; and a duct for delivering liquid to said upper channel.

27. A steam iron station according to claim 26 wherein said upper channel and said lower channel are on opposite sides of said soleplate.

28. A steam iron station according to claim 27 comprising:

a bottom plate attached to said soleplate for covering said lower channel.

29. A steam iron station according to claim 28 comprising:

a top plate attached to said soleplate for covering said upper channel.

30. A steam iron station according to claim 26 wherein said soleplate has a hole for allowing communications between said upper channel and said lower channel.

31. A steam iron station comprising:

a case having a removable, fixedly held tank with an outlet;

a removable filter having an intake and being mounted at said case to communicate with said tank;

a conduit adapted to be coupled to said steam iron;

a pump mounted in said case and coupled to said filter from said tank.

32. A steam iron station according to claim 31 wherein said case comprises:

a heat resistant, upper deck adapted to support a steam iron.

33. A steam iron station according to claim 31 comprising:

manually operable latch means for releasably securing said tank to said case.

34. A steam iron station according to claim 31 wherein said filter comprises:

a cartridge containing a filter material; and a baffle mounted in said cartridge for dividing it into an upstream and downstream path.

35. A steam iron station according to claim 34 wherein said tank is removable, said baffle acting as a weir for restricting draining through said outlet upon removal of said removable tank.

36. A steam iron station according to claim 31, said tank comprising:

valve means mounted at said intake of said filter for stopping flow thereto upon removal of said filter from said tank.

37. A steam iron station according to claim 31 wherein said pump comprises a piston, said station comprising:

a pump controller for reciprocating said piston for a predetermined burst interval.

38. A steam iron station according to claim 31 comprising:

a steam iron having a soleplate with a steam producing chamber coupled to said conduit.

39. A steam iron station according to claim 38 wherein said steam iron includes:

a manual control coupled to said pump for changing its rate of discharge.

40. A steam iron station according to claim 39 wherein said steam iron comprises a duct communicating between said conduit and said steam producing chamber for carrying liquid without diversion out of said duct for storage inside said steam iron.

41. A steam iron station according to claim 38 comprising:

an electrical heater mounted in said soleplate, said soleplate having an upper channel and a lower channel, said upper and said lower channels each having a forward flowing and a backward flowing branch, said upper channel serially communicating with said lower channel; and a duct for delivering liquid to said upper channel.

42. A steam iron station according to claim 41 wherein said upper channel and said lower channel are on opposite sides of said soleplate.

43. A steam iron station according to claim 42 comprising:

a bottom plate attached to said soleplate for covering said lower channel.

44. A steam iron station according to claim 43 comprising:

a top plate attached to said soleplate for covering said upper channel.

45. A steam iron station according to claim 41 wherein said soleplate has a hole for allowing communications between said upper channel and said lower channel.

46. A steam iron station comprising:

a case;

a removable tank mounted in said case;

a conduit adapted to be coupled to a steam iron;

a pump having a piston, said pump being electrically operable and mounted in said case and coupled to said tank and said conduit for discharging to said conduit liquid drawn from said tank;

a pump controller for plurally reciprocating said piston for a predetermined burst interval, followed by a quiescent interval; and said pump controller comprising a capacitive timing means for establishing said burst and said quiescent intervals by charging and discharging at different rates.

47. A steam iron station according to claim 46 wherein said pump controller comprises:

a switching means adapted to be coupled to a source of alternating current for applying a plurality of unidirectional current pulses to said pump during said burst interval.

* * * * *